US009498868B2

(12) United States Patent
Quaiz

(10) Patent No.: US 9,498,868 B2
(45) Date of Patent: Nov. 22, 2016

(54) CLAMPING ASSEMBLY

(71) Applicant: Majed F. Quaiz, Beaverton, OR (US)

(72) Inventor: Majed F. Quaiz, Beaverton, OR (US)

( * ) Notice: Subject to any disclaimer, the term of this patent is extended or adjusted under 35 U.S.C. 154(b) by 63 days.

(21) Appl. No.: 14/622,816

(22) Filed: Feb. 13, 2015

(65) Prior Publication Data

US 2016/0067845 A1 Mar. 10, 2016

Related U.S. Application Data

(60) Provisional application No. 62/070,837, filed on Sep. 8, 2014.

(51) Int. Cl.

| | |
|---|---|
| ***B25B 1/10*** | (2006.01) |
| ***B25B 5/00*** | (2006.01) |
| ***B25B 5/10*** | (2006.01) |
| ***B25B 5/14*** | (2006.01) |
| ***B25B 5/16*** | (2006.01) |

(52) U.S. Cl.

CPC ..... *B25B 5/006* (2013.01); *B25B 5/003* (2013.01); *B25B 5/102* (2013.01); *B25B 5/142* (2013.01); *B25B 5/163* (2013.01)

(58) Field of Classification Search

CPC ..... B25B 5/00; B25B 5/02; B25B 1/00

See application file for complete search history.

(56) References Cited

U.S. PATENT DOCUMENTS

| | | | | |
|---|---|---|---|---|
| 2,991,669 | A | 7/1961 | Stock | |
| 4,226,409 | A * | 10/1980 | Hanna | B25B 5/003 269/154 |
| 4,247,090 | A * | 1/1981 | Hahn | B25B 5/142 269/295 |
| 4,256,295 | A * | 3/1981 | Egner | B25B 5/003 269/152 |
| 4,881,726 | A * | 11/1989 | Jolkovski | B25B 5/142 269/164 |
| 4,984,775 | A * | 1/1991 | Kahlke | B25B 1/20 269/126 |
| 5,401,354 | A | 3/1995 | Colucci | |
| 2010/0244342 | A1 | 9/2010 | Zander | |
| 2016/0067845 | A1 * | 3/2016 | Quaiz | B25B 5/006 29/559 |

OTHER PUBLICATIONS

U.S. Receiving Office of WIPO, International Search Report and Written Opinion of PCT Patent Application No. PCT/US2015/048715, mailed Nov. 27, 2015, 10 pages.

* cited by examiner

*Primary Examiner* — Lee D Wilson
(74) *Attorney, Agent, or Firm* — Kolisch Hartwell, P.C.

(57) ABSTRACT

A clamping system may include one or more clamps configured to be placed in travelling engagement with respective legs of a frame. Workpieces such as wood panels may be clamped against the frame by jaws of the one or more clamps. The one or more clamps may be easily repositionable along the legs of the frame.

19 Claims, 8 Drawing Sheets

CLAMPING ASSEMBLY

CROSS-REFERENCES

The following related applications and materials are incorporated herein, in their entireties, for all purposes: U.S. Provisional Patent Application No. 62/070,837, filed Sep. 8, 2014.

FIELD

This disclosure relates to a clamping assembly. More specifically, the disclosed embodiments relate to systems and methods for clamping workpieces to a frame.

INTRODUCTION

Frequently, in the field of carpentry and similar arts, two or more workpieces must be clamped in a fixed mutual relationship. For example, two wooden panels may be clamped at a right angle to form the corner of a larger structure. Clamping may be performed to keep workpieces in the desired relationship while glue dries, while fasteners such as screws or nails are inserted, while surface coating is applied, and/or any number of other operations common in the art.

However, clamping multiple workpieces using standard C-clamps, carpentry squares, and the like can be cumbersome and difficult, especially for a single operator.

SUMMARY

The present disclosure provides systems and methods relating to clamping systems for use in carpentry and related arts. In some embodiments, a clamp assembly may include a frame including a leg portion and a first mating portion; and a clamp including a first jaw portion, a second jaw portion selectively movable toward and away from the first jaw portion, and a second mating portion configured to engage the first mating portion of the leg of the frame; wherein, when the first mating portion is engaged with the second mating portion, the first and second jaws straddle the leg portion and the clamp is selectively movable along a long axis of the leg portion.

In some embodiments, a clamping system may include an assembly square including a first leg portion and a second leg portion, respective proximal ends of the first and second leg portions being connected to form a corner, the first leg portion and the second leg portion each having a respective elongate mating portion running parallel to a long axis of the respective leg portion; and a clamp including a movable jaw and a mating portion configured to engage the elongate mating portion of the first leg portion to form a translating joint; the system being operable in a first configuration, wherein the clamp is engaged with the assembly square at the translating joint, the movable jaw is configured to move selectively toward and away from the first leg portion, and the clamp is configured to travel selectively along the length of the first leg portion, and a second configuration, wherein the clamp is disengaged from the assembly square.

In some embodiments, a method of securing a workpiece may include attaching a first clamp to a corner square by engaging a first mating portion on the first clamp with a complementary second mating portion on a first leg of the corner square; repositioning the first clamp along the first leg of the corner square by sliding the clamp along a length of the first leg while maintaining engagement between the first and second mating portions; and securing a first workpiece against the first leg of the corner square by applying a clamping force to the first workpiece using a jaw of the first clamp.

Features, functions, and advantages may be achieved independently in various embodiments of the present disclosure, or may be combined in yet other embodiments, further details of which can be seen with reference to the following description and drawings.

DESCRIPTION

Overview

Various embodiments of a clamping assembly having one or more clamps mated with a frame are described below and illustrated in the associated drawings. Unless otherwise specified, a clamping assembly and/or its various components may, but are not required to, contain at least one of the structure, components, functionality, and/or variations described, illustrated, and/or incorporated herein. Furthermore, the structures, components, functionalities, and/or variations described, illustrated, and/or incorporated herein in connection with the present teachings may, but are not required to, be included in other embodiments of clamping assemblies, including as part of a larger device or system. The following description of various embodiments is merely exemplary in nature and is in no way intended to limit the disclosure, its application, or uses. Additionally, the advantages provided by the embodiments, as described below, are illustrative in nature and not all embodiments provide the same advantages or the same degree of advantages.

In general, a clamping assembly in accordance with aspects of the present disclosure will include a frame having a first mating portion, and one or more clamps having a second mating portion. The first and second mating portions cooperate to secure the clamp(s) to the frame in a repositionable fashion. Accordingly, clamping one or more workpieces (e.g., boards, panels) to the frame is made significantly simpler, as the clamps are secured to the frame but also easily repositionable. In some embodiments, manual repositioning of the clamp(s) may be accomplished by an operator using a single hand. This capability frees the other hand of the operator, for example, to hold the workpiece or manipulate a tool.

Figure 1:
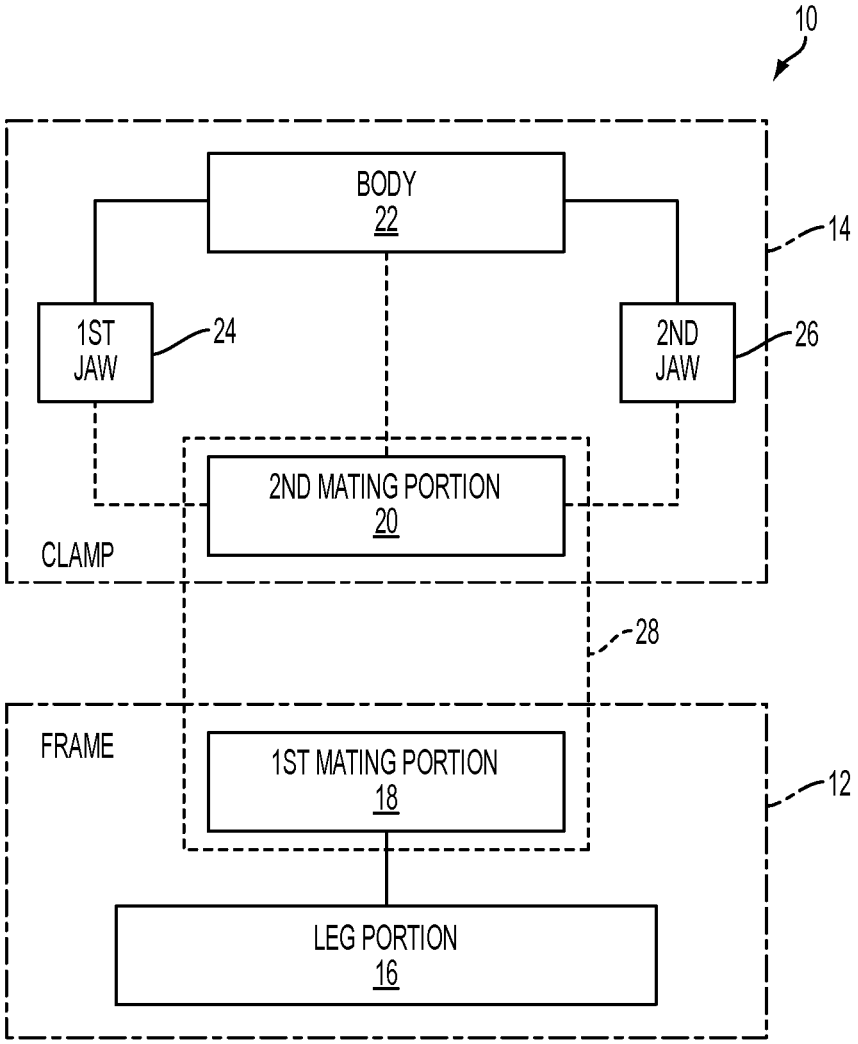
FIG. 1 is a schematic diagram of an illustrative clamping assembly in accordance with aspects of the present disclosure.

Referring now to FIG. 1, a clamping assembly 10 includes a frame 12 and a clamp 14. In some embodiments, multiple clamps 14 may be included. For example, two substantially identical clamps may be included. The number of clamps may correspond to the number of leg portions of frame 12.

Frame 12 may include one or more leg portions 16. Leg portion 16 may include any suitable frame member configured as a rigid, elongate surface against which a workpiece may be clamped. Accordingly, one or more workpieces may be clamped against a single leg portion 16. If multiple leg portions are included, the leg portions may be arranged at a predetermined and/or adjustable angle with respect to each other. For example, two leg portions 16 may be arranged at a ninety degree angle to form an L-shaped frame. The two leg portions may be mutually connected at respective proximal ends (e.g., in a fixed angular relationship). In some embodiments, a single leg portion 16 may be included. In some embodiments, two workpieces may be clamped to respective leg portions 16 at a fixed angle, as commonly performed using a tool known as an assembly square.

Leg portion 16 includes a first mating portion 18. First mating portion 18 may include any suitable structure configured to secure clamp 14 to frame 12 by mating in a repositionable manner with a corresponding second mating portion 20 on clamp 14. First mating portion 18 may be disposed on or in any suitable surface of leg portion 16, and may be present on or in more than one such surface. In other words, there may be more than one first mating portion 18.

In some embodiments, second mating portion 20 includes a shaped protrusion, and first mating portion 18 includes a slot, channel, or track configured to receive the protrusion. In some embodiments, first mating portion 18 may include the protrusion and second mating portion 20 the channel. In some embodiments, the first mating portion may include a channel having a cross-sectional shape, and the second mating portion may include a protrusion having an outer perimeter corresponding to the cross-sectional shape of the channel. In some embodiments, the two mating portions 18 and 20 may include a grasping member and a rail or bar to be grasped. The first and second mating portions may comprise a male connector and a female connector, respectively, or vice versa. In some embodiments, the clamp may include a clamp mating portion having a shaped protrusion and the leg portion may include an elongate mating portion having a channel with a cross-sectional profile complementary to the shaped protrusion.

First mating portion 18 and second mating portion 20 may be configured to slide or otherwise reposition along the long axis of leg portion 16. The first and second mating portions may be further configured to lock into a selectable position along the length of leg portion 16. In other words, the translating joint formed by engagement of the first and second mating portions may include a releasable locking mechanism configured to selectively restrict movement of a clamp in a direction parallel to the long axis of the leg portion. The locking mechanism may be configured to bias the second mating portion against the first mating portion of the first leg portion in a direction transverse to the long axis. In some examples, a releasable locking mechanism may be integrated into one or both of the mating portions.

Clamp 14 may include any suitable structure and/or mechanism configured to exert selected and/or adjustable pressure from at least two directions with respect to leg portion 16 of frame 12. In the example depicted in FIG. 1, clamp 14 includes a body 22, a first jaw 24, and a second jaw 26. In some embodiments, first jaw 24 is fixed, and second jaw 26 is movable toward and away from first jaw 24. Accordingly, pressure may be exerted on a workpiece to hold the workpiece against leg portion 16 by placing first jaw 24 on one side of leg portion 16 and adjusting second jaw 26 to apply pressure to the workpiece. In some embodiments, the clamp may further include an adjustment mechanism operatively connected to the movable second jaw. Manipulation of the adjustment mechanism may be configured to selectively reposition the movable jaw. In some embodiments, both first jaw 24 and second jaw 26 may be adjustable or otherwise movable toward and away from each other.

Body 22 may include any suitable base structure configured to provide a rigid brace for the jaws. For example, first jaw 24 may be affixed to or unitary with body 22 and second jaw 26 may be adjustable along a length of body 22. Adjustability may be achieved by way of a manual adjustment mechanism, such as a threaded member and rotatable knob. In some embodiments, adjustment mechanisms may include a cam lever, a jack, a spring, a ratcheting member, or the like, and/or any combination of these. Adjustment may be accomplished or assisted by a separate tool, whether manual or powered, such as a wrench, a driver, or the like.

Each of first jaw 24 and second jaw 26 may include any suitable structure configured to transfer clamping force to the workpiece and/or frame 12. For example, a jaw may include a flat plate, a shaped plate configured to match an expected workpiece, a hook, a block, a ribbed or otherwise textured surface, a resilient pad, a shaped member, or the like, or any combination of these. In some embodiments, first jaw 24 may have a different structure as compared with second jaw 26. In some embodiments, first jaw 24 and second jaw 26 may be operatively connected to each other, directly or indirectly, such that body 22 comprises the connection between the two clamps.

Protruding mating portions may be referred to as male mating portions. Recessed mating portions, or mating portions otherwise configured to receive a male mating portion, may be referred to as female mating portions. First mating portion 18 and second mating portion 20 may each be male or female, with the other mating portion having the opposite configuration. In some examples, first mating portion 18 may include a male protrusion and second mating portion 20 may include a female recess or channel. In other examples, the opposite may be true. In some examples, both first mating portion 18 and second mating portion 20 may include both male and female portions, each oriented to mate with corresponding features on the other mating portion.

Second mating portion 20 may be formed as or operatively connected to any one of body 22, first jaw 24, or second jaw 26, as depicted in FIG. 1. For example, second mating portion 20 may be formed as a male protrusion or female channel on first jaw 24. In some embodiments, second mating portion 20 may be formed in or on body 22. In some embodiments, second mating portion 20 may be formed in or on second jaw 26. In some embodiments, second mating portion 20 may be formed in or on a stationary jaw. In some embodiments, second mating portion 20 may be formed in or on a movable jaw. Collectively, first mating portion 18 and second mating portion 20 may form a releasable and/or repositionable joint or engagement mechanism 28.

Based on the above description, one embodiment of a clamping assembly in accordance with aspects of the present disclosure may include a frame including a leg portion and a first mating portion. The clamping assembly may include a clamp including a first jaw portion, a second jaw portion selectively movable toward and away from the first jaw portion, and a second mating portion configured to engage the first mating portion of the leg of the frame. When the first mating portion is engaged with the second mating portion, the first and second jaws may straddle the leg portion and the clamp may be selectively movable along a long axis of the leg portion.

Based on the above description, another embodiment of a clamping assembly in accordance with aspects of the present disclosure may include an assembly square including a first leg portion and a second leg portion, respective proximal ends of the first and second leg portions being connected to form a corner. The first leg portion and the second leg portion may each have a respective elongate mating portion running parallel to a long axis of the respective leg portion. A clamp may have a movable jaw and a clamp mating portion configured to engage the elongate mating portion of the first leg portion to form a translating joint. This system may be operable in a first configuration, wherein the clamp is engaged with the assembly square at the translating joint, the movable jaw is configured to move selectively toward and away from the first leg portion, and the clamp is configured to travel selectively along the length of the first leg portion, and a second configuration, wherein the clamp is disengaged from the assembly square.

Examples, Components, and Alternatives

The following sections describe selected aspects of exemplary clamping assemblies, as well as related systems and/or methods. These examples are intended for illustration and should not be interpreted as limiting the entire scope of the present disclosure. Each section may include one or more distinct inventions, and/or contextual or related information, function, and/or structure.

Section 1:

This Section describes an illustrative clamping assembly 100 having a sliding dovetail joint; see FIGS. 2-7. Clamping assembly 100 is an embodiment of clamping assembly 10. Accordingly, corresponding features may be labeled with corresponding reference numbers in the drawings.

Figure 2:
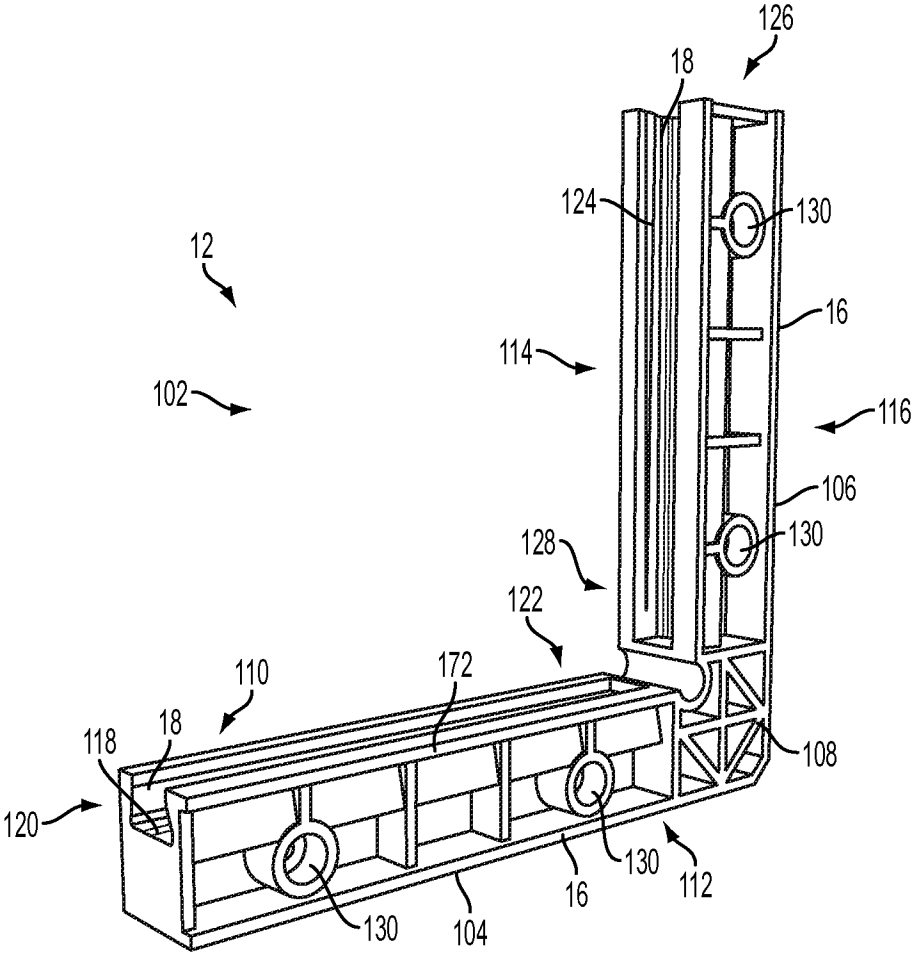
FIG. 2 is an isometric view of an illustrative frame suitable for use in a clamping assembly in accordance with aspects of the present disclosure.

Clamping assembly 100 includes an L-shaped frame 102, depicted in FIG. 2. Frame 102 may be interchangeably referred to as a square, a corner square, an assembly square, and/or an L-frame. Frame 102 includes two leg portions 104, 106, arranged at a fixed ninety degree angle. In some embodiments, the two leg portions may be operatively connected by a hinged or otherwise selectively rotatable member, thereby facilitating adjustability of the angle between leg 104 and 106. Leg portions 104 and 106 are generally rectangular and elongate members, and are attached to each other by a mutual corner portion 108. Corner portion 108 includes an inner corner having a radius relief to prevent damage to workpiece(s). Corner portion 108 also includes a truncated outer corner relief to permit escape of excess glue, provide visibility of reference lines, etc. Leg portion 104 includes a mating surface 110 and a clamping surface 112 opposite the mating surface. Likewise, leg portion 106 includes a mating surface 114 and an opposing clamping surface 116.

A channel 118 is formed parallel to the long axis of leg portion 104 in mating surface 110. The channel has a first end and a second end opposite the first end, the first end being open, such that a protrusion on a clamp is able to pass into and out of the first end in a direction substantially parallel to the long axis of the leg portion. In other words, the channel has a closed proximal end and an open distal end. More specifically, channel 118 may have an open end 120 at a distal end of leg portion 104 and a closed end 122 at a proximal end of leg portion 104. Similarly, leg portion 106 includes a channel 124 having an open end 126 and a closed end 128.

Each of the channels may include any suitable structure configured to function as first mating portion 18 for a corresponding second mating portion 20 on the clamp. In this embodiment, channels 118 and 124 have a generally trapezoidal cross section, with a narrow mouth at surface 110, 114 transitioning via sloping or tapered walls to a wider floor. Each channel is configured to form a dovetail joint with the second mating portion on the clamp (described below). Open ends 120 and 126 may be larger than the respective closed ends 122 and 128. This may, for example, facilitate manufacturability and/or engagement with the second mating portion. In some examples, end 120 and/or end 126 are closed, thereby preventing removal of a clamp from the channel in a longitudinal direction.

Legs 104 and 106 may have a substantially identical length and width, and may be configured to lay flat on a work surface. In the embodiment depicted in FIG. 2, a plurality of mounting holes 130 are included at spaced intervals on each leg portion. Mounting holes 130 may be countersunk, and may be configured to permit securing of the frame to a work surface. For example, frame 102 may be attached to a flat work surface (e.g., a table or workbench) by inserting screws into the surface through mounting holes 130.

Figure 3:
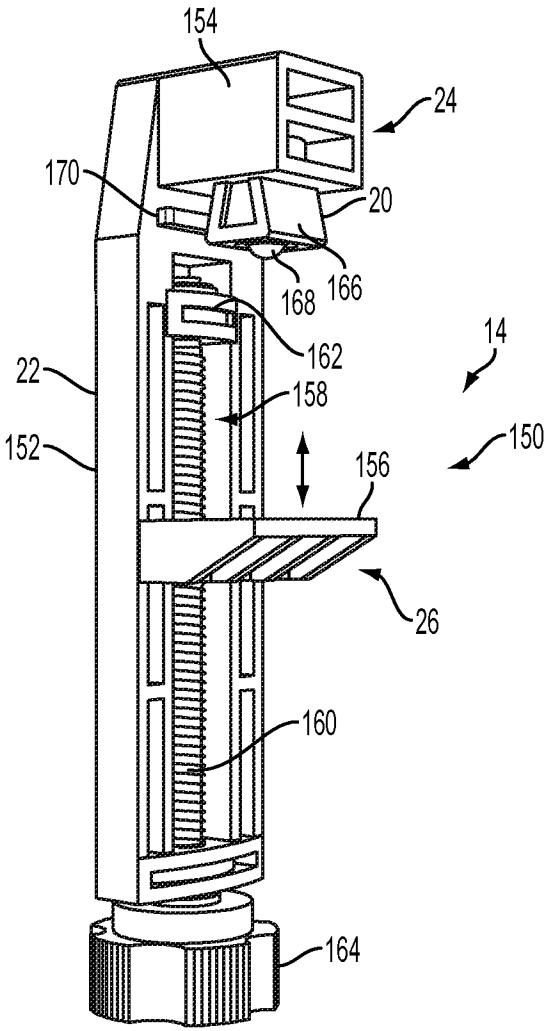
FIG. 3 is an isometric view of an illustrative clamp suitable for use in a clamping assembly in accordance with aspects of the present disclosure.

Clamping assembly 100 includes two clamps 150, depicted in FIG. 3. In this embodiment, clamps 150 are substantially identical. Accordingly, only a single clamp 150 will be described in detail. Clamp 150 includes a body portion 152, a first jaw 154, and a second jaw 156. Clamp 150 may be interchangeably referred to as a clamp assembly, a screw clamp, or a screw clamp assembly. In this embodiment, first jaw 154 is affixed to or unitary with body portion 152, and may be referred to as a stationary jaw or fixed jaw.

Second jaw 156 is movable or adjustable along the length of body 152, such that second jaw 156 moves toward and away from the fixed jaw. Accordingly, second jaw 156 may be referred to as a movable jaw or adjustable jaw. Second jaw 156 is operatively connected to an adjustment mechanism 158. Adjustment mechanism 158 includes a threaded member 160, on which second jaw 156 is engaged by way of a threaded aperture. Threaded member 160 is rotatable in a bushing 162 at one end by a manual adjustment knob 164 at the other end.

Movable jaw 156 may include a flat plate, as depicted in FIG. 3. Some flexion of the plate or the connection between jaw 156 and mechanism 158 may result from application of clamping force to a workpiece. Accordingly, to maintain contact with the workpiece and efficiently transmit the clamping force evenly, the flat plate of jaw 156 may include a positive rake angle. In other words, when not under load, the flat clamping surface of jaw 156 may form a slightly acute angle with the plane defined generally by body 152. The inventor has found that a rake angle of approximately one degree may be suitable.

The flat plate of movable jaw 156 extends transversely from body 152 as described. Jaw 156 may be sized such that the jaw extends approximately the same distance as the width of the leg to which the clamp is attached. In other words, if clamp 150 is engaged with leg portion 104 and the assembly is laid on a flat work surface with frame 102 flat on the surface, jaw 156 would contact and terminate at the flat work surface. This arrangement facilitates clamping of thin workpieces between jaw 156 and leg 104, where thin refers to the size dimension orthogonal to the support surface.

As discussed above, clamp 150 includes second mating portion 20, which in this embodiment is a dovetail protrusion 166 having a generally trapezoidal shape. Protrusion 166 is configured to mate with channel 118 or 124, such that the protrusion may be passed into respective open end 120 or 126 of the channel and slid along the channel to a desired position. This mating of the protrusion with the channel may be described as a translating joint that is configured to restrict motion of the clamp in a direction transverse to the long axis of the leg portion while permitting translation of the clamp in a direction parallel to the long axis of the leg portion.

To facilitate releasable locking of clamp 150 at a position along the channel, a locking mechanism 168 is included in protrusion 166. Locking mechanism 168 may include any suitable member biased to press against the floor of channel 118, thereby forcing the angled sides of protrusion 166 against the angled walls of the channel. The angled sides and walls of the dovetail joint prevent decoupling of the clamp from the channel, while the force of the locking mechanism resists relative movement between the clamp and frame. The dovetail joint also allows travel or relative movement (i.e., sliding) along the channel length when the locking mechanism is overridden or released. In this embodiment, locking mechanism 168 includes a spring-loaded ball plunger having a ball that is spring-biased to extend from the distal face of protrusion 166.

Body 152 of clamp 150 includes a lip 170 formed adjacent to the fixed jaw. Lip 170 may include any suitable projection or other structure configured to fit under a ledge portion 172 of the frame (also referred to as a flange) and/or to contact a side face of the frame. This lip feature functions to reduce or prevent racking motion by urging the clamp to remain at a right angle relative to the frame.

Figure 4:
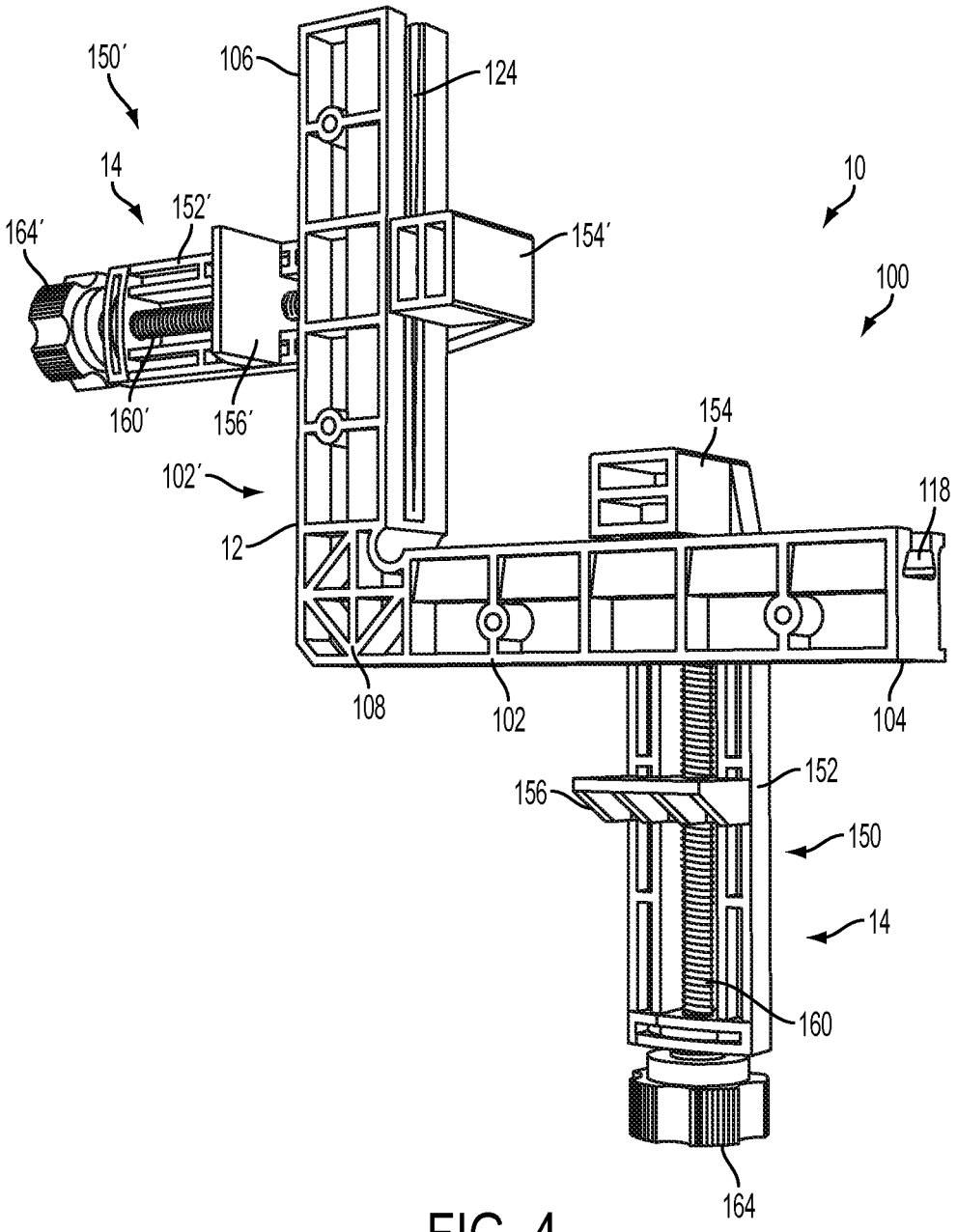
FIG. 4 is an isometric view of an illustrative clamping assembly in accordance with aspects of the present disclosure.
Figure 5:
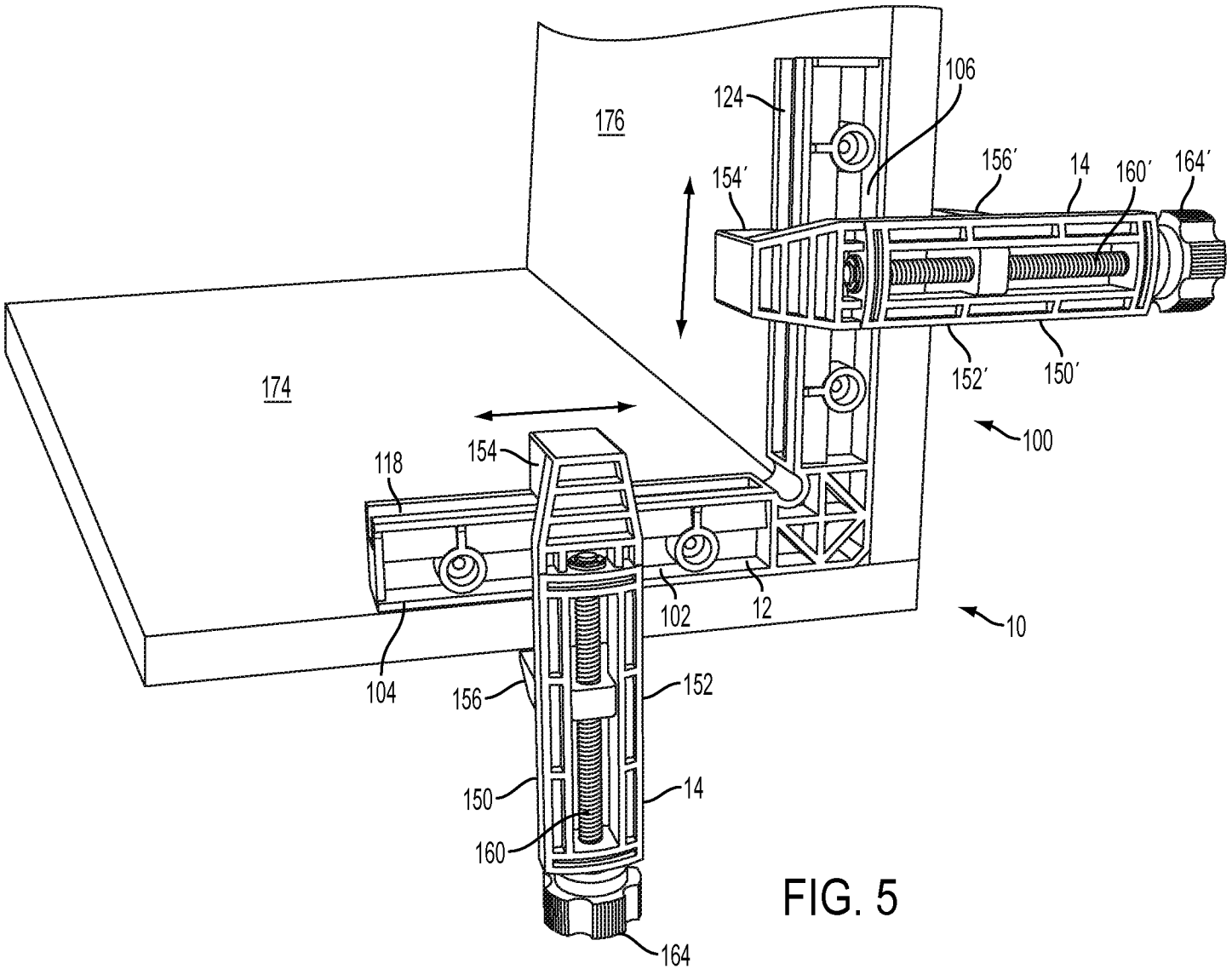
FIG. 5 is a view of the clamping assembly of FIG. 4 in an illustrative mode of use, holding two workpieces at a fixed angle.
Figure 7:
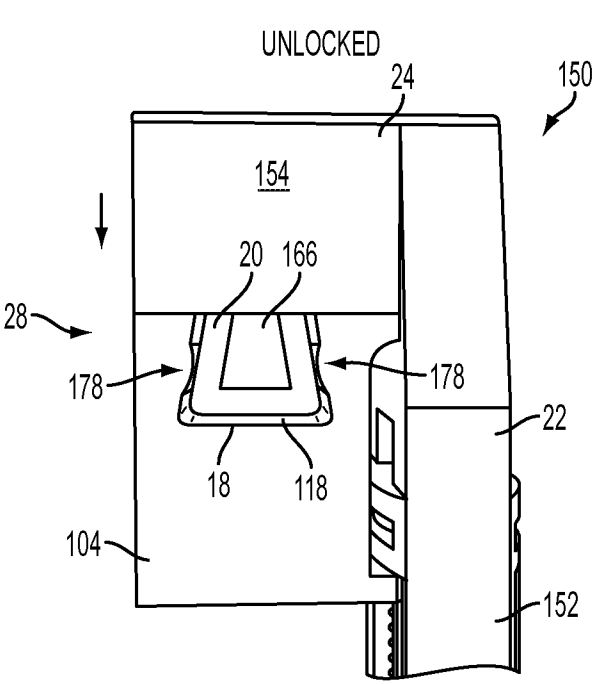
FIG. 7 is an end elevation view of the portions depicted in FIG. 6, with the portions in an unlocked position.
Figure 6:
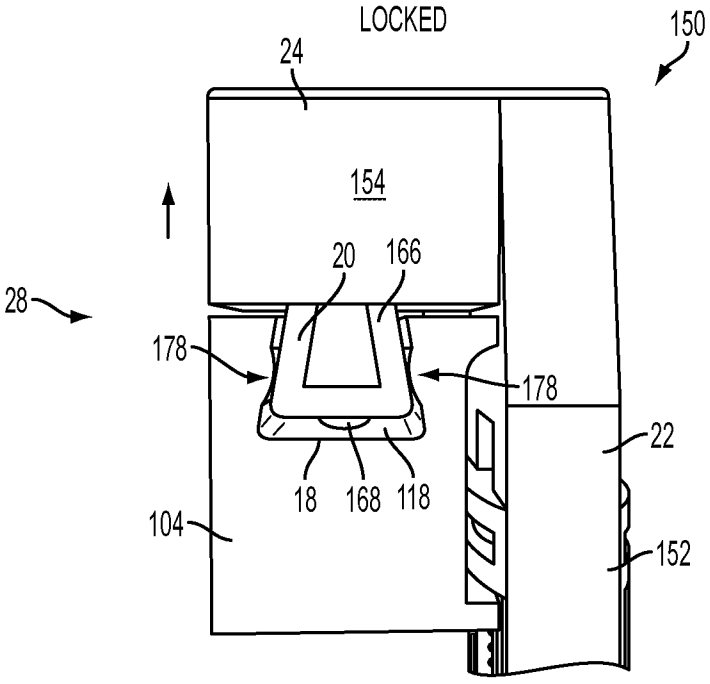
FIG. 6 is an end elevation view of illustrative mating portions of a clamp and frame, with the portions in a locked position.

Turning to FIGS. 4 and 5, clamping assembly 100 is shown with two clamps 150 slidably engaged with legs 104 and 106 of frame 102. For convenience, the two clamps are labeled 150 and 150', with corresponding components having corresponding unprimed and primed reference numbers.

As depicted in FIGS. 4 and 5, clamp 150 may be engaged with leg portion 104 by inserting protrusion 166 into channel 118. Likewise, clamp 150' may be engaged with leg portion 106 by inserting protrusion 166' into channel 124. The clamps may then be slid along the channel to a desired position.

As shown in FIG. 5, clamping assembly 100 may be used to hold a first workpiece 174 at a fixed angle relative to a second workpiece 176. In this example, workpieces 174 and 176 are panels or flat boards being held at a ninety degree angle by clamping assembly 100. Workpiece 174 is held against leg portion 104 by jaws 154 and 156 of clamp 150. Workpiece 176 is held against leg portion 106 by jaws 154' and 156' of clamp 150'. As shown in FIG. 5 and elsewhere, the jaws of each clamp are arranged such that the jaws straddle the leg to which the clamp is engaged. In general, this means that jaw 154 is disposed on one side of leg portion 104, adjacent mating surface 110, while jaw 156 is disposed on the opposite side of leg portion 104, adjacent to and at an adjustable distance from clamping surface 112. As shown in FIG. 5, jaws 154 and 156 straddle both the workpiece and the leg, meaning jaw 154 is on the mating surface side of leg portion 104, and jaw 156 is on the opposite, clamping side of the leg portion with workpiece 174 sandwiched between jaw 156 and leg portion 104. A similar arrangement is depicted with respect to clamp 150' and workpiece 176.

Depending on alternative locations for the first and second mating portions, workpieces may be clamped in the jaws of clamps 150 and/or 150' in various arrangements. For example, if channel 118 were located on the opposite (i.e., outside edge) surface of leg 104, protrusion 166 would then be located on jaw 156. Accordingly, clamping of workpiece 174 would be conducted between surface 110 and jaw 154 rather than surface 112 and jaw 156. Based on this example, one skilled in the art will recognize that various suitable arrangements are possible without departing from the teachings of this disclosure.

In the embodiment described in this Section, sliding of the clamp along the channel must be accompanied by releasing or overcoming the locking feature of mechanism 168. This may be accomplished, for example, by pressing fixed jaw 154 toward leg portion 104 or otherwise overcoming the spring pressure of the ball plunger. Releasing the pressure on fixed jaw 154 allows the self-locking feature to re-engage and secure the lateral position of the clamp. See FIGS. 6 and 7, which depict this unlocking/locking operation in more detail. An inward bulge 178 may run lengthwise along the walls of channel 118 (and 124) to further facilitate the locking and unlocking functionality of the dovetail joint. In other embodiments, more or fewer locking features may be present. For example, a locking feature or mechanism 168 may not be included.

Figure 9:
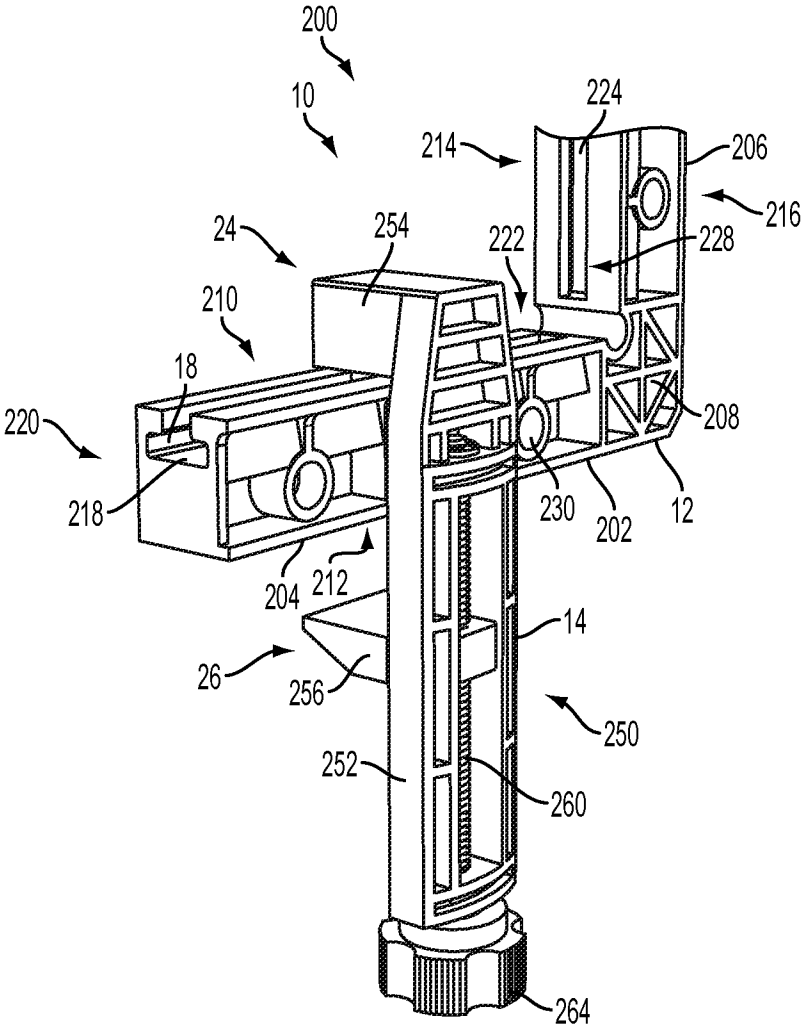
FIG. 9 depicts the clamp of FIG. 8 mated with an illustrative corresponding frame.
Figure 8:
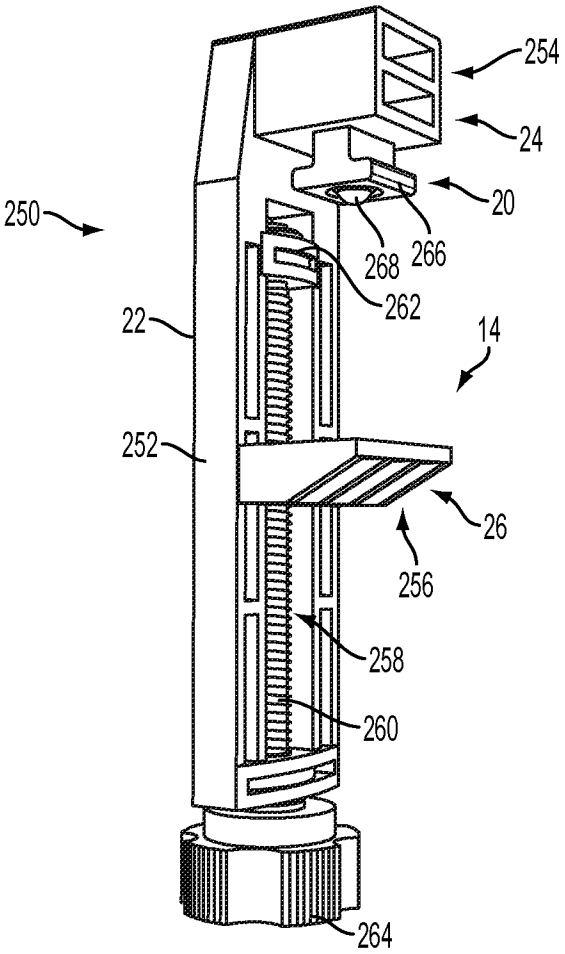
FIG. 8 is an isometric view of another embodiment of a clamp suitable for use in a clamping assembly in accordance with aspects of the present disclosure.

Section 2:

This Section describes an illustrative clamping assembly 200 having a sliding T-shaped joint; see FIGS. 8-9. Clamping assembly 200 is an embodiment of clamping assembly 10. Accordingly, corresponding features may be labeled with corresponding reference numbers in the drawings.

Clamping assembly 200 is similar in many respects to clamping assembly 100, but with a significantly different engagement mechanism 28. Clamping assembly 200 includes a frame 202 having a first leg 204 connected to a second leg 206 at a corner portion 208, engageable with one or more clamps 250, all substantially as described above regarding assembly 100. Components of frame 202 and clamp 250 correspond to the components of frame 102 and clamp 150, and are labeled with similar reference numbers having the general form "2XX" rather than "1XX." Accordingly, features 210, 212, 214, 216, 220, 222, 228, 230, 252, 254, 256, 258, 260, 262, and 264 are substantially identical to their respective counterparts in Section 1, namely features 110, 112, 114, 116, 120, 122, 128, 130, 152, 154, 156, 158, 160, 162, and 164.

As indicated above, however, clamping assembly 200 includes different embodiments of the first mating portion and second mating portion. Specifically, clamp 250 includes a T-shaped protrusion 266 configured to mate with T-shaped channels 218 and 224. As depicted in FIGS. 8 and 9, protrusion 266 includes a stem terminating in a tee portion oriented orthogonal to the stem. Channels 218 and 224 have a corresponding cross-section. Protrusion 266 is engageable with the channels by sliding into, for example, open end 220. As with the dovetail joint, T-shaped protrusion 266 includes a locking mechanism 268 in the form of a spring-loaded ball plunger.

Locking mechanism 268 is configured to bias the upper surfaces of the tee of protrusion 266 against the corresponding surfaces of the channel, thereby preventing lateral movement (i.e., along the length of the channel). The biasing force may be overcome manually, as described above regarding locking mechanism 168. In other words, a user may press down on stationary jaw 254 to overcome the spring of the ball plunger of mechanism 268. While maintaining the downward force, the user can then slide clamp 250 to a desired position along channel 218 or 224. Once the desired position is achieved, releasing the downward force causes the ball to extend. Extension of the ball presses the tee of protrusion 266 against the channel, thereby resisting further repositioning of the clamp.

Figure 11:
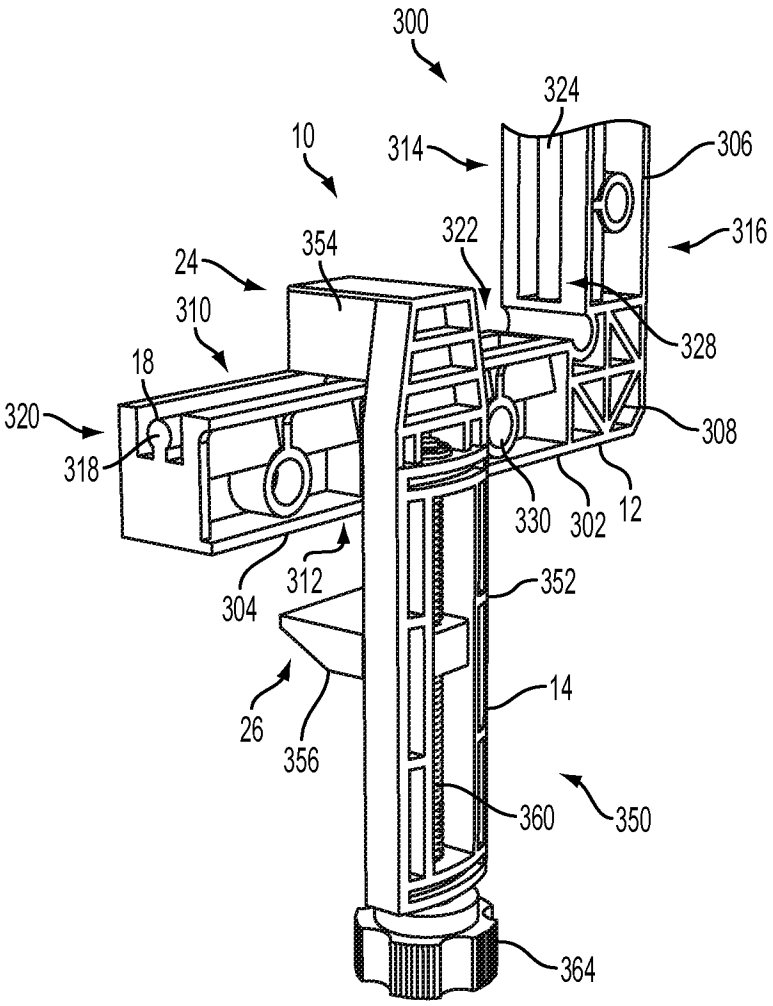
FIG. 11 depicts the clamp of FIG. 10 mated with an illustrative corresponding frame.
Figure 10:
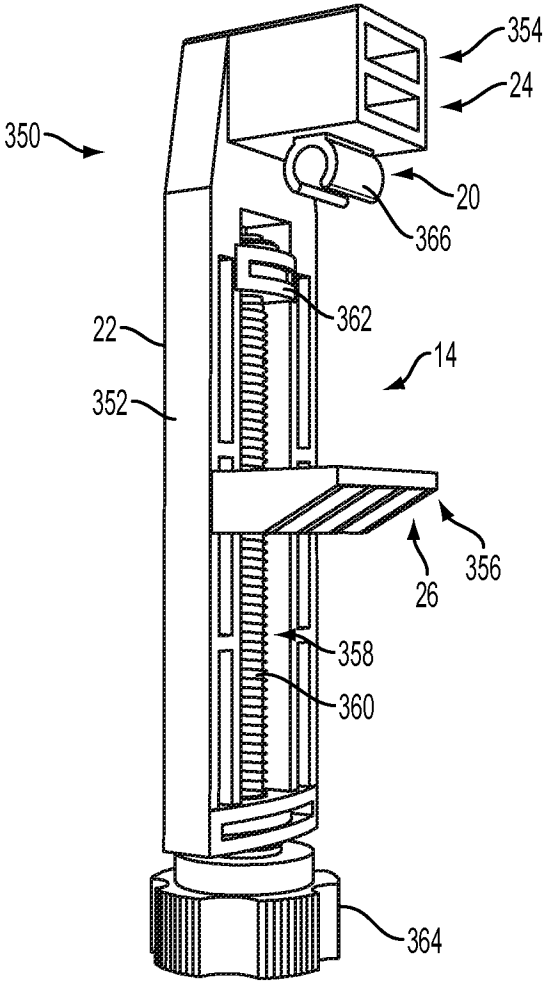
FIG. 10 is an isometric view of another embodiment of a clamp suitable for use in a clamping assembly in accordance with aspects of the present disclosure.

Section 3:

This Section describes an illustrative clamping assembly 300 having an engagement mechanism in the form of a rail and a rail-grasping member; see FIGS. 10-11. Clamping assembly 300 is an embodiment of clamping assembly 10. Accordingly, corresponding features may be labeled with corresponding reference numbers in the drawings.

Clamping assembly 300 is similar in many respects to clamping assemblies 100 and 200, again with a significantly different engagement mechanism 28. Clamping assembly 300 includes a frame 302 having a first leg 304 connected to a second leg 306 at a corner portion 308, engageable with one or more clamps 350, all substantially as described above regarding assembly 100. Components of frame 302 and clamp 350 correspond to the components of frame 102 and clamp 150, and are labeled with similar reference numbers having the general form "3XX" rather than "1XX." Accordingly, features 310, 312, 314, 316, 320, 322, 328, 330, 352, 354, 356, 358, 360, 362, and 364 are substantially identical to their respective counterparts in Section 1, namely features 110, 112, 114, 116, 120, 122, 128, 130, 152, 154, 156, 158, 160, 162, and 164.

As indicated, clamping assembly 300 includes embodiments of the first mating portion and second mating portion that differ from those described above. Specifically, clamp 350 includes a rail-grasping member, also referred to as a clip-type protrusion 366 configured to mate with a bar or rail in the form of an elongate cylindrical portion running lengthwise in each of channels 318 and 324. The elongate cylindrical portions, in this embodiment, are anchored to the floor of the channels by a stem portion having a width thinner than the cylindrical diameter.

The rail-grasping member has an inner shape that conforms to an outer shape of the rail. In this embodiment, protrusion 366 includes a "fuse-clip" style of connector having a pair of curved, opposing arms that together form a generally cylindrical inner passage between the arms. Each arm terminates in a distal end spaced from the distal end of the other arm, resulting in a gap between the distal ends. The arms are of a length sufficient to embrace or grasp greater than half of the circumference of a corresponding cylinder in the inner passage. The clip portion of protrusion 366 may be interchangeably referred to as a clip, a grasping portion, a rail-grasping member, or a bar-grasping member.

The arms of the clip portion may be flexible, such that a cylinder may be passed or snapped into and out of the clip through the gap between the arms. In some embodiments, the arms may be inflexible and/or the gap may be small compared to the perimeter of the rail (e.g., the diameter of the cylinder). In these embodiments, the rail or cylinder must be passed axially through an open end of the clip rather than radially through the gap. In the embodiment depicted in FIGS. 10 and 11, the clip of protrusion 366 is configured to be placed onto the central raised cylinder portion of channel 318 at open end 320. The cylinder portion and clip are configured to mate in a friction fit, such that clamp 350 may be caused to travel along the length of leg portion 304 by overcoming the friction between the clip and the cylinder. In some embodiments, the legs of the clip portion may be forced apart by pressing the fixed jaw toward the channel, thereby reducing contact and friction between the clip and the rail during relocation.

Although the clip and cylinder portions are described as having rounded features, other shapes and sizes of the components may be suitable. For example, the clip arms may be configured to embrace an elongate member having a square, rectangular, or triangular cross section. In some embodiments, the clip arms may be configured to embrace an elongate member anchored to a side wall of channel 318 rather than to the floor as depicted in the drawings.

Unlike the first mating portions and second mating portions described in Sections 1 and 2, the mating portions of clamping assembly 300 include a member on the frame that is received by an opening on the clamp. In other words, clamp 350 includes a female mating portion 20 and frame 302 includes one or more male mating portions 18. In addition, the female mating portion of the clamp is disposed in a projecting member, while the male mating portion of the frame is disposed in a recessed channel.

Figure 12:
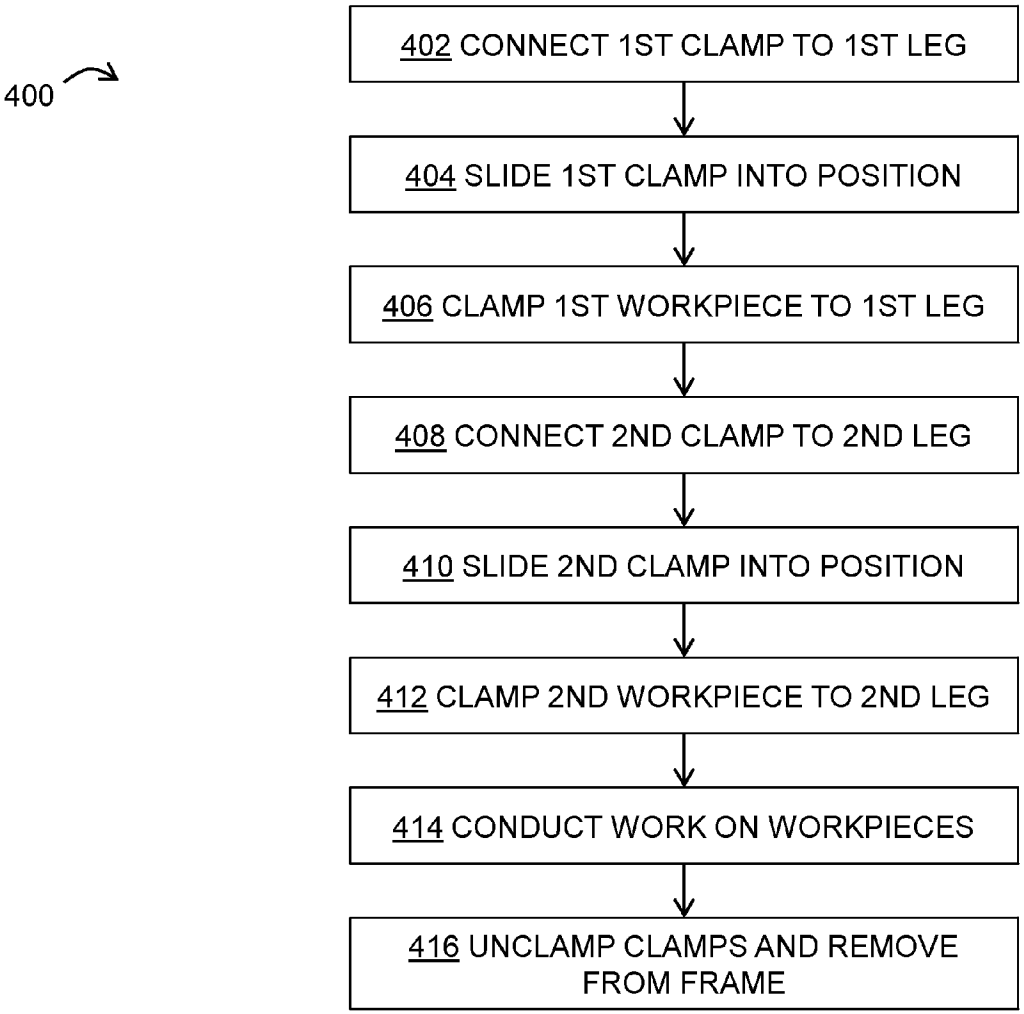
FIG. 12 is a flow chart depicting steps of an illustrative method for securing workpieces to a frame using a clamping assembly in accordance with aspects of the present disclosure.

Section 4:

This example describes a method for clamping a plurality of workpieces in a fixed mutual relationship; see FIG. 12. Aspects of the clamping assemblies described in Sections above may be utilized in the method steps described below. Where appropriate, reference may be made to previously described components and systems that may be used in carrying out each step. These references are for illustration, and are not intended to limit the possible ways of carrying out any particular step of the method.

FIG. 12 is a flowchart illustrating steps performed in an illustrative method, and may not recite the complete process or all steps of the method. FIG. 12 depicts multiple steps of a method, generally indicated at 400, which may be performed in conjunction with a clamping assembly according to aspects of the present disclosure. Although various steps of method 400 are described below and depicted in FIG. 12, the steps need not necessarily all be performed, and in some cases may be performed in a different order than the order shown.

At step 402, a first clamp may be operatively connected with a first leg of a frame by engaging a first mating portion on the first leg with a second mating portion on the first clamp. The second mating portion may be disposed on a body portion or a jaw portion of the first clamp. For example, clamp 150 may be operatively connected to leg portion 104 of frame 102 by engaging protrusion 166 into channel 118. For example, protrusion 166 may be passed into channel 118 through open end 120.

In some examples, step 402 may include operatively connecting a plurality of clamps to the first leg. In some embodiments, this step may be described as attaching a first clamp to a corner square by engaging a first mating portion on the first clamp with a complementary second mating portion on a first leg of the corner square. Attaching the first clamp to the corner square may include establishing a mated connection that restricts movement of the clamp in a direction transverse to a long axis of the first leg. Engaging the first mating portion on the first clamp with the second mating portion on the first leg may include inserting a shaped protrusion on the first clamp into a channel having a complementary cross-sectional profile on the first leg. For example, the mated connection may include a sliding dovetail joint.

At step 404, the first clamp may be caused to travel along a length of the first leg to a desired position. Step 404 may be performed by an operator using a single hand. For example, clamp 150 may be slid along channel 118 to a position between open end 120 and closed end 122. The engaged mating portions may form a repositionable joint or engagement mechanism. This step may include releasing or overcoming a self-locking feature of the joint. For example, locking mechanism 166 of clamp 150 may be overridden by applying pressure on the clamp toward the mating surface between jaw 156 and leg 104.

Step 404 may be repeated as necessary to achieve a desired position or series of positions. If a plurality of clamps were connected to the leg in step 402, all such clamps may be positioned in step 404. In some embodiments, this step may be described as repositioning a first clamp along the first leg of a corner square by sliding the clamp along a length of the first leg while maintaining engagement between the first and second mating portions.

At step 406, a first workpiece may be secured against the first leg by clamping the first workpiece between the first leg and a jaw of the first clamp. The first clamp may include a pair of jaws that straddle the first leg when the first clamp is engaged with the first leg. In this step, the pair of jaws may straddle both the first leg and the first workpiece. The jaws of the first clamp may include a movable jaw. The movable jaw may be adjustable toward and away from the first leg. The movable jaw may provide a selectable amount of clamping force. For example, jaw 156 of clamp 150 may be repositioned using adjustment knob 164 of adjustment mechanism 158. This repositioning may be performed in such a way that jaw 156 contacts and applies pressure to the first workpiece. Jaw 154 may be in contact with an opposite side of first leg 104 to provide an opposing squeeze force for the workpiece.

If a plurality of clamps are installed on the first leg, some or all of the clamps may be used to clamp the workpiece against the first leg in this step 406. In some embodiments, this step may be described as securing a first workpiece against the first leg of a corner square by applying a clamping force to a first workpiece using a jaw of a first clamp. Repositioning the first clamp may include releasing a locking mechanism preventing the first clamp from sliding along the length of the first leg. Repositioning the first clamp and securing the first workpiece may both be performed manually using a same single hand.

At step 408, a second clamp may be operatively connected to a second leg of the frame by engaging a first mating portion on the second leg with a second mating portion on the second clamp. The second mating portion may be disposed on a body portion or a jaw portion of the second clamp. For example, clamp 150' may be operatively connected to leg portion 106 of frame 102 by engaging protrusion 166' into channel 124. For example, protrusion 166' may be passed into channel 124 through open end 126. The second clamp may be substantially identical to the first clamp. As in step 402, a plurality of clamps may be connected during this step.

At step 410, the second clamp may be caused to travel along a length of the second leg to a desired position. Step 410 may be performed by an operator using a single hand. For example, clamp 150' may be slid along channel 124 to a position between open end 126 and closed end 128. The engaged mating portions may form a repositionable joint or engagement mechanism. This step may include releasing or overcoming a self-locking feature of the joint. For example, locking mechanism 166' of clamp 150' may be overridden by applying pressure on the clamp toward the mating surface between jaw 156' and leg 106. Step 410 may be repeated as necessary to achieve a desired position or series of positions. If a plurality of clamps were connected to the leg in step 408, all such clamps may be positioned in step 410.

At step 412, a second workpiece may be secured against the second leg by clamping the second workpiece between the second leg and a jaw of the second clamp. The second clamp may include a pair of jaws that straddle the second leg when the second clamp is engaged with the second leg. In this step, the pair of jaws may straddle both the second leg and the second workpiece. The jaws of the second clamp may include a movable jaw. The movable jaw may be adjustable toward and away from the second leg. The movable jaw may provide a selectable amount of clamping force. For example, jaw 156' of clamp 150' may be repositioned using adjustment knob 164' of adjustment mechanism 158'. This repositioning may be performed in such a way that jaw 156' contacts and applies pressure to the second workpiece. Jaw 154' may be in contact with an opposite side of second leg 106 to provide an opposing squeeze force for the workpiece. If a plurality of clamps are installed on the second leg, some or all of the clamps may be used to clamp the workpiece against the second leg in this step.

At step 414, work may be conducted on the first and/or second workpieces. For example, the workpieces may be glued together and the glue may be allowed to dry. For example, additional components or workpieces may be attached to the clamped workpieces.

At step 416, when the work of step 414 is completed or otherwise no longer necessary, the first and second clamps may be released from the respective workpieces. Step 416 may further include removing one or both clamps from the frame, such that the frame, first clamp, and second clamp are three separate components. Step 416 may further include storing the clamps and frame, together or separately.

Section 5:

This section describes additional aspects and features of clamp assemblies, presented without limitation as a series of paragraphs, some or all of which may be alphanumerically designated for clarity and efficiency. Each of these paragraphs can be combined with one or more other paragraphs, and/or with disclosure from elsewhere in this application, including the materials incorporated by reference in the Cross-References, in any suitable manner. Some of the paragraphs below expressly refer to and further limit other paragraphs, providing without limitation examples of some of the suitable combinations.

A0. A clamp assembly comprising:

a frame including a leg portion and a first mating portion; and a clamp including a first jaw portion, a second jaw portion selectively movable toward and away from the first jaw portion, and a second mating portion configured to engage the first mating portion of the leg of the frame;

wherein, when the first mating portion is engaged with the second mating portion, the first and second jaws straddle the leg portion and the clamp is selectively movable along a long axis of the leg portion.

A1. The clamp assembly of paragraph A0, wherein the leg portion is a first leg portion, the frame further including a second leg portion substantially identical to the first leg portion, the first and second leg portions being connected at respective proximal ends.

A2. The clamp assembly of paragraph A1, wherein the first and second leg portions are connected in a fixed angular relationship.

A3. The clamp assembly of paragraph A2, wherein the fixed angular relationship is a right angle.

A4. The clamp assembly of any of paragraphs A0-A3, wherein the first mating portion is a female connector and the second mating portion is a male connector.

A5. The clamp assembly of any of paragraphs A0-A4, wherein the first mating portion includes a channel having a cross-sectional shape, and the second mating portion includes a protrusion having an outer perimeter corresponding to the cross-sectional shape of the channel.

A6. The clamp assembly of paragraph A5, wherein the channel has a first end and a second end opposite the first end, the first end being open, such that the protrusion of the second mating portion is able to pass into and out of the first end in a direction substantially parallel to the long axis of the leg portion.

A7. The clamp assembly of paragraph A5 or A6, wherein the protrusion is disposed on the first jaw portion of the clamp.

A8. The clamp assembly of any of paragraphs A0-A7, wherein the first mating portion and the second mating portion form a sliding dovetail joint.

A9. The clamp assembly of any of paragraphs A0-A8, wherein the first mating portion includes a rail, and the second mating portion includes a rail-grasping member having an inner shape that conforms to an outer shape of the rail.

B0. A clamping system comprising:

an assembly square including a first leg portion and a second leg portion, respective proximal ends of the first and second leg portions being connected to form a corner, the first leg portion and the second leg portion each having a respective elongate mating portion running parallel to a long axis of the respective leg portion; and a clamp including a movable jaw and a clamp mating portion configured to engage the elongate mating portion of the first leg portion to form a translating joint;

the system being operable in a first configuration, wherein the clamp is engaged with the assembly square at the translating joint, the movable jaw is configured to move selectively toward and away from the first leg portion, and the clamp is configured to travel selectively along the length of the first leg portion, and a second configuration, wherein the clamp is disengaged from the assembly square.

B1. The clamping system of paragraph B0, wherein the translating joint is configured to restrict motion of the clamp in a direction transverse to the long axis of the first leg portion while permitting translation of the clamp in a direction parallel to the long axis of the first leg portion.

B2. The clamping system of paragraph B0 or B1, the clamp mating portion including a shaped protrusion and the elongate mating portion including a channel having a cross-sectional profile complementary to the shaped protrusion.

B3. The clamping system of paragraph B2, wherein the channel has a closed proximal end and an open distal end.

B4. The clamping system of any of paragraphs B0-B3, the translating joint further including a releasable locking mechanism configured to selectively restrict movement of the clamp in a direction parallel to the long axis of the first leg portion.

B5. The clamping system of paragraph B4, wherein the locking mechanism is configured to bias the clamp mating portion against the elongate mating portion of the first leg portion in a direction transverse to the long axis.

B6. The clamping mechanism of paragraph B5, wherein the locking mechanism includes a spring-biased ball plunger.

B7. The clamping mechanism of any of paragraphs B0-B6, the clamp further including an adjustment mechanism operatively connected to the movable jaw, wherein manipulation of the adjustment mechanism is configured to selectively reposition the movable jaw.

C0. A method of securing a workpiece, the method including:

attaching a first clamp to a corner square by engaging a first mating portion on the first clamp with a complementary second mating portion on a first leg of the corner square;

repositioning the first clamp along the first leg of the corner square by sliding the clamp along a length of the first leg while maintaining engagement between the first and second mating portions; and securing a first workpiece against the first leg of the corner square by applying a clamping force to the first workpiece using a jaw of the first clamp.

C1. The method of paragraph C0, wherein repositioning the first clamp includes releasing a locking mechanism preventing the first clamp from sliding along the length of the first leg.

C2. The method of any of paragraphs C0-C1, wherein repositioning the first clamp and securing the first workpiece are both performed manually using a same single hand.

C3. The method of any of paragraphs C0-C2, wherein attaching the first clamp to the corner square includes establishing a mated connection that restricts movement of the clamp in a direction transverse to a long axis of the first leg.

C4. The method of paragraph C3, wherein the mated connection includes a sliding dovetail joint.

C5. The method of any of paragraphs C0-C4, further including securing a second workpiece against a second leg of the corner square using a second clamp.

C6. The method of paragraph C5, further including attaching the second clamp to the corner square by engaging a first mating portion on the second clamp with a complementary second mating portion on the second leg.

C7. The method of any of paragraphs C0-C6, wherein engaging the first mating portion on the first clamp with the second mating portion on the first leg includes inserting a shaped protrusion on the first clamp into a channel having a complementary cross-sectional profile on the first leg.

Advantages, Features, Benefits

The different embodiments of the clamping systems and methods described herein provide several advantages over known solutions for holding workpieces in a fixed relationship. For example, illustrative embodiments of clamping systems described herein allow one-handed clamp relocation and workpiece clamping. Additionally, and among other benefits, illustrative embodiments of the clamping systems described herein facilitate self-locking, repositionable clamps engaged with a corner square or other frame. Thus, the illustrative embodiments described herein are particularly useful for cabinetry and other carpentry. However, not all embodiments described herein provide the same advantages or the same degree of advantage.

CONCLUSION

The disclosure set forth above may encompass multiple distinct inventions with independent utility. Although each of these inventions has been disclosed in its preferred form(s), the specific embodiments thereof as disclosed and illustrated herein are not to be considered in a limiting sense, because numerous variations are possible. The subject matter of the invention(s) includes all novel and nonobvious combinations and subcombinations of the various elements, features, functions, and/or properties disclosed herein. The following claims particularly point out certain combinations and subcombinations regarded as novel and nonobvious. Invention(s) embodied in other combinations and subcombinations of features, functions, elements, and/or properties may be claimed in applications claiming priority from this or a related application. Such claims, whether directed to a different invention or to the same invention, and whether broader, narrower, equal, or different in scope to the original claims, also are regarded as included within the subject matter of the invention(s) of the present disclosure.

I claim:

1. A clamp assembly comprising:

a frame including a leg portion and a first mating portion; and a clamp including a first jaw portion, a second jaw portion selectively movable toward and away from the first jaw portion, and a second mating portion configured to engage the first mating portion of the leg of the frame;

wherein, when the first mating portion is engaged with the second mating portion, the first and second jaws straddle the leg portion and the clamp is selectively movable along a long axis of the leg portion; and wherein the first mating portion is a dovetail channel and the second mating portion is a dovetail protrusion.

2. The clamp assembly of claim 1, wherein the leg portion is a first leg portion, the frame further including a second leg portion substantially identical to the first leg portion, the first and second leg portions being mutually connected at respective proximal ends.

3. The clamp assembly of claim 2, wherein the first and second leg portions are connected in a fixed angular relationship.

4. The clamp assembly of claim 1, wherein the dovetail channel has a first end and a second end opposite the first end, the first end being open, such that the protrusion of the second mating portion is able to pass into and out of the first end in a direction substantially parallel to the long axis of the leg portion.

5. The clamp assembly of claim 1, wherein the dovetail protrusion is disposed on the first jaw portion of the clamp.

6. A clamping system comprising:

an assembly square including a first leg portion and a second leg portion, respective proximal ends of the first and second leg portions being connected to form a corner, the first leg portion and the second leg portion each having a respective elongate mating portion running parallel to a long axis of the respective leg portion; and a clamp including a movable jaw and a clamp mating portion configured to engage the elongate mating portion of the first leg portion to form a translating joint;

the system being operable in a first configuration, in which the clamp is engaged with the assembly square at the translating joint, the movable jaw is configured to move selectively toward and away from the first leg portion, and the clamp is configured to travel selectively along the length of the first leg portion, and a second configuration, in which the clamp is disengaged from the assembly square;

wherein each of the elongate mating portions on the assembly square is a dovetail channel, and the clamp mating portion is a dovetail protrusion.

7. The clamping system of claim 6, wherein the translating joint is configured to restrict motion of the clamp in a direction transverse to the long axis of the first leg portion while permitting translation of the clamp in a direction parallel to the long axis of the first leg portion.

8. The clamping system of claim 6, wherein each of the dovetail channels has a closed proximal end and an open distal end.

9. The clamping system of claim 6, the translating joint further including a releasable locking mechanism configured to selectively restrict movement of the clamp in a direction parallel to the long axis of the first leg portion.

10. The clamping system of claim 9, wherein the locking mechanism is configured to bias the clamp mating portion against the elongate mating portion of the first leg portion in a direction transverse to the long axis.

11. The clamping mechanism of claim 6, the clamp further including an adjustment mechanism operatively connected to the movable jaw, wherein manipulation of the adjustment mechanism is configured to selectively reposition the movable jaw.

12. A method of manufacturing a clamping system, the method including:

providing a clamp comprising a jaw having a first mating portion, the first mating portion being one of a male dovetail protrusion or a female dovetail channel; and providing a corner square comprising a leg having a second mating portion, the second mating portion being the other of the male dovetail protrusion or the female dovetail channel, such that the second mating portion is complementary to the first mating portion and the clamp is attachable to the corner square by engaging the first mating portion on the clamp with the second mating portion on the leg of the corner square;

wherein the clamp is positionable along the leg of the corner square by sliding the clamp along a length of the leg while maintaining engagement between the first and second mating portions.

13. The method of claim 12, wherein the clamp includes a releasable locking mechanism preventing the clamp from sliding along the length of the leg.

14. The method of claim 12, wherein attaching the clamp to the corner square includes establishing a mated connection that restricts movement of the clamp in a direction transverse to a long axis of the leg.

15. The method of claim 14, wherein the mated connection includes a sliding dovetail joint.

16. The method of claim 12, wherein engaging the first mating portion on the clamp with the second mating portion on the leg includes inserting the dovetail protrusion into the dovetail channel at a distal end of the leg.

17. The clamp assembly of claim 1, the clamp further including a releasable locking mechanism configured to selectively restrict movement of the clamp in a direction parallel to the long axis of the leg portion.

18. The clamp assembly of claim 17, wherein the locking mechanism is configured to bias the dovetail protrusion against the dovetail channel in a direction transverse to the long axis of the leg portion.

19. The clamp assembly of claim 17, the locking mechanism comprising a spring-loaded ball plunger.

* * * * *